US007173881B1

(12) United States Patent
Freudenberg, Jr. et al.

(10) Patent No.: US 7,173,881 B1
(45) Date of Patent: Feb. 6, 2007

(54) SILENT MORNING ALARM

(76) Inventors: Frank J Freudenberg, Jr., 1035 Ardmore Rd., Baldwin, NY (US) 11510; Rich Fehringer, 90 East 7th St., Deer Park, NY (US) 11729

( * ) Notice: Subject to any disclaimer, the term of this patent is extended or adjusted under 35 U.S.C. 154(b) by 0 days.

(21) Appl. No.: 10/610,409

(22) Filed: Jun. 30, 2003

(51) Int. Cl.
*G04F 10/00* (2006.01)
*G08B 21/00* (2006.01)
*G08B 13/00* (2006.01)
*G08B 13/08* (2006.01)

(52) U.S. Cl. ..... 368/1; 368/10; 368/12; 340/540; 340/541; 340/547; 340/545.1; 340/545.2

(58) Field of Classification Search ..... 368/1, 368/10, 12, 46–62; 340/540, 547, 541, 545.1, 340/545.2
See application file for complete search history.

(56) References Cited

U.S. PATENT DOCUMENTS

| | | | | |
|---|---|---|---|---|
| 256,265 | A | 4/1882 | Applegate | |
| 2,703,344 | A | 3/1955 | Anderson | |
| 3,786,628 | A | 1/1974 | Fossard et al. | |
| 4,093,944 | A | 6/1978 | Muncheryan | |
| 4,297,677 | A | 10/1981 | Lewis et al. | |
| 4,380,759 | A | 4/1983 | Sulkoski et al. | |
| 4,456,387 | A | 6/1984 | Igarashi | |
| 4,728,934 | A | 3/1988 | Pfander et al. | |
| 4,777,474 | A * | 10/1988 | Clayton | 340/539.11 |
| 5,651,070 | A * | 7/1997 | Blunt | 381/56 |
| 5,686,882 | A | 11/1997 | Giani | |
| 5,764,594 | A | 6/1998 | Berman et al. | |
| 5,867,105 | A | 2/1999 | Hajel | |
| 6,151,278 | A | 11/2000 | Najarian | |
| 6,301,196 | B1 * | 10/2001 | Daniel | 368/10 |
| 6,384,724 | B1 * | 5/2002 | Landais | 340/531 |
| 6,563,422 | B1 * | 5/2003 | Wiget et al. | 340/540 |
| 2003/0117272 | A1 * | 6/2003 | Fegley et al. | 340/309.3 |

* cited by examiner

*Primary Examiner*—Tulsidas C. Patel
*Assistant Examiner*—Thanh S. Phan
(74) *Attorney, Agent, or Firm*—Michael I. Kroll

(57) ABSTRACT

A alarm system for providing silent notification to a user including an alarm device. The alarm device includes means for generating an alarm signal, and a transmitter connected to the generating means for transmitting the alarm signal. The system further includes a notification device. The notification device includes a receiver for receiving the alarm signal and means for alerting a user that the notification device has received the alarm signal from the alarm device.

2 Claims, 10 Drawing Sheets

SILENT MORNING ALARM

BACKGROUND OF THE INVENTION

1. Field of the Invention

The present invention relates generally to an alarm system and, more specifically, to a wireless silent alarm apparatus including a notification device having a receiver for receiving an alarm signal emitted by an alarm apparatus. A user may selectively set the alarm apparatus to emit the alarm signal at a predetermined time. Upon receiving the alarm signal a silent notification device is activated for notifying the user without disturbing any people in the immediate vicinity. The alarm apparatus may be able to transmit a plurality of alarm signals for receipt by a plurality of notification devices for notifying different users at various times.

2. Description of the Prior Art

Numerous other vibratory and skin sensation signaling devices exist in the prior art. Typical of these is U.S. Pat. No. 256,265 issued to Samuel S. Applegate on Apr. 11, 1832.

Another patent was issued to Attell B. Anderson on Mar. 1, 1955 as U.S. Pat. No. 2,703,344. Yet another U.S. Pat. No. 3,786,628 was issued to Hubert Rene Louis Fossard on Jan. 22, 1974 and still yet another was issued on Jun. 6, 1978 to Hrand M. Muncheryan as U.S. Pat. No. 4,093,944.

Another patent was issued to Kazunobu Igarashi on Jun. 26, 1984 as U.S. Pat. No. 4,456,387. Yet another U.S. Pat. No. 4,297,677 was issued to John S. Lewis on Oct. 27, 1981 and still yet another was issued on Apr. 19, 1983 to Jerome Sulkoski as U.S. Pat. No. 4,380,759.

Another patent was issued to Wilhelm Pfander on Mar. 1, 1988 as U.S. Pat. No. 4,728,934. Yet another U.S. Pat. No. 5,686,882 was issued to Sandra M. Giani on Nov. 11, 1997 and still yet another was issued on Jun. 9, 1998 to Paul Berman as U.S. Pat. No. 5,764,594.

Another patent was issued to Stephen A. Sprigg on Aug. 23, 2001 by the World Intellectual Property Organization as Patent No. WO01/61873A1. Yet another U.S. Pat. No. 5,867,105 was issued to William F. Hajel on Feb. 2, 1999 and still yet another was issued on Nov. 21, 2000 to David Najarian as U.S. Pat. No. 6,151,278.

While the above vibratory and skin sensation type signaling devices may be suitable for the purposes for which they were designed, they would not be as suitable for the purposes of the present invention, as hereinafter described.

U.S. Pat. No. 256,265

Inventor: Samuel S. Applegate

Issued: Apr. 11, 1832

The object of this invention is to construct a simple and effective device for waking persons from sleep at any time which may have previously been determined upon, the device being also adapted for use in connection with an electric or other burglar-alarm apparatus, in place of the usual gong-alarms.

U.S. Pat. No. 2,703,344

Inventor: Attell B. Anderson

Issued: Mar. 1, 1955

This invention relates to methods of and systems for conveying intelligence by electrical stimulation of the skin.

U.S. Pat. No. 3,786,628

Inventor: Hubert Rene Louis Fossard

Issued: Jan. 22, 1974

A warning device particularly useful for the deaf of partially deaf comprising a mechanical vibration generator responsive to signals produced by a trigger signal generator to which it is operatively connected, the trigger signal generator being responsive to various external sources of different natures, such as an alarm clock, a door bell, or a car horn.

U.S. Pat. No. 4,093,944

Inventor: Hrand M. Muncheryan

Issued: Jun. 6, 1978

An electronic system for silently awakening a sleeping person without disturbing others sleeping in the same room and, when desired, for inducing sleep in a person unable to fall asleep naturally is disclosed. The system consists of a signal triggering means comprising either an electric clock or a fire-smoke detection device provided therein with an electronic circuitry having two channels, one channel for developing awakening signals and the other for producing sleep-inducing signals. Said system is further provided with a stimulus-directing means, to be positioned under a sleeping person's pillow for receiving stimuli from said electronic circuitry into said stimulus-directing means and transmitting therefrom continuous as well as recurrent, pulsative motion through said pillow to a person lying thereon, as in sleeping or resting.

U.S. Pat. No. 4,456,387

Inventor: Kazunobu Igarashi

Issued: Jun. 26, 1984

A silent alarm wrist watch is disclosed wherein the human wrist is vibrated directly by a vibration means at a preset alarm time. The vibration means are energized by an electric signal at a composite frequency made up of two or more frequencies (repetition rates), each selected from a range, one higher, one lower, and both in the range of 0 to 300 Hz. The invention permits low energy consumption of the electric power source in the watch, and effective recognition of the alarm vibration.

U.S. Pat. No. 4,297,677

Inventor: John S. Lewis

Issued: Oct. 27, 1981

A personally worn or portable annunciator device for alerting, warning, training, communicating or diagnostic use for people especially those with hearing impairments. This device which can be activated locally or remotely has as one of its means of generating a tactile sensation a transducer or buzzer, as well as a visual light both of which are activated automatically upon the detection of an audio signal substantially above the local ambient noise, or by a RF signal remotely generated by an auxiliary unit.

U.S. Pat. No. 4,380,759

Inventor: Jerome Sulkoski

Issued: Apr. 19, 1983

An apparatus to alert a deaf person made up of an alarm device such as a smoke detector adapted to vibrate when actuated by smoke and a transmitter having a vibration sensor connected to the transmitter. The vibration sensor is supported in engagement with the smoke detector and adapted to sense the vibrations of the smoke detector and to transmit a signal to a remotely located receiver. The receiver has a vibrating reed with a tactical member on its end for engaging a person to alert him when the receiver causes the reed to be vibrated.

U.S. Pat. No. 4,728,934

Inventor: Wilhelm Pfander

Issued: Mar. 1, 1988

An electro-acoustical transmitter converts electrical signals which correspond to acoustical events into mechanical vibrations which are transmitted onto the skin. The aim is to achieve a small vibrator which, insofar as possible, can be worn on the wrist, for instance, in the manner of a wristwatch. To that end, a coil is employed into which a magnetic core, resiliently mounted relative thereto for instance by a diaphragm, projects as an armature. The housing which carries both the diaphragm and the coil forms the magnetic return flux path. Thus, a miniaturization of the vibrator on the desired order is achieved. An inventive vibrator is particularly suited for the deaf.

U.S. Pat. No. 5,686,882

Inventor: Sandra M. Giani

Issued: Nov. 11, 1997

The silent alarm comprises a wrist band housing which can be attached to the wrist of a person. A signal receiving device is mounted in the wrist band housing for receiving a signal from a clock controlled transmitter. Vibratory means are also mounted in the housing and are connected to the signal receiving device. A battery is mounted in the wrist band to energize the vibratory means when the signal receiving device receives a signal in order to quietly awaken a sleeping person wearing the wrist band.

U.S. Pat. No. 5,764,594

Inventor: Paul Berman

Issued: Jun. 9, 1998

A silent alarm clock including a portable receiver unit with a wrist watch-type configuration. The receiver unit includes a vibrator adapted to create a vibrating sensation upon the receipt of a radio signal. To provide power to the receiver unit a rechargeable battery is included with a pair of associated contacts and a charger adapted to allow the recharging thereof. Also included is a base transmitter unit with a recharging base having a pair of contacts for contacting those of the receiver unit in a recharge orientation. A clock unit is situated within the base transmitter unit having associated control circuitry and a speaker. The clock circuitry is adapted to define at least two predetermined times. The base transmitter unit is adapted to transmit an audio signal via the speaker at a predetermined time if the receiver unit is the recharge orientation thereof and further generate a radio signal via free space if the receiver unit is not in the recharge orientation. Thus, a first user is awakened via the vibrator at the first predetermined time and places the receiver unit within the recharging base thereafter. A second user is then awakened at the second predetermined time via the audio alarm.

U.S. Pat. No. 5,867,105

Inventor: William F. Hajel

Issued: Feb. 2, 1999

A wireless alarm system for generating alarm signals discernible to the hearing impaired. The system includes a detection unit having a smoke or carbon dioxide detector which generates a signal upon sensing the occurrence of smoke or carbon dioxide. A transmitter in the detector unit generates a wirelessly transmitted signal. A receiving unit worn on the body of a person includes a receiver and receives the signal generated by the transmitter. An alarm in the form of a vibrator is coupled with the receiver and generates a vibration discernible to the body of the user. A second alarm operates, or not, depending on whether the person acknowledges the vibrator.

U.S. Pat. No. 6,151,278

Inventor: David Najarian

Issued: Nov. 21, 2000

An improved programmable and remote-controlled device for awakening a user through the user's sense of touch is disclosed. The device utilizes a time keeping alarm circuit to accurately track and display time and also to output an alarm signal at a user-defined preset alarm time. The alarm signal is modulated, amplified, encrypted, and transmitted to a receiving unit. The receiving unit is strapped to or otherwise held against the user's body. The receiving unit decodes the received encrypted alarm signal and activates a vibrating mechanism utilized to awaken the user via the vibrating mechanism without relying upon an audible alarm.

World Patent Number WO 01/61873 A1

Inventor: Stephen A. Sprigg

Issued: Aug. 23, 2001

A wireless telephone has a power supply, which supplies power to a counter, a processor, a wireless modem, and a transceiver. The transceiver communicates with the outside world through an antenna. The processor exchanges signals with a clock-calendar. When the telephone is in power-conservation mode, the processor opens a switch between the power supply and the transceiver and modem. A second switch is interposed between the power supply and the processor, and is under the control of the counter. Thus, in power-conservation mode, only the counter draws power.

Power-conservation mode may be exited by external command, a signal from the clock-calendar, or an attempt to place an outgoing call.

SUMMARY OF THE PRESENT INVENTION

The present invention relates generally to an alarm system and, more specifically, to a wireless silent alarm apparatus including a notification device having a receiver for receiving an alarm signal emitted by an alarm apparatus. A user may selectively set the alarm apparatus to emit the alarm signal at a predetermined time. Upon receiving the alarm signal a silent notification device is activated for notifying the user without disturbing any people in the immediate vicinity. The alarm apparatus may be able to transmit a plurality of alarm signals for receipt by a plurality of notification devices for notifying different users at various times.

A primary object of the present invention is to provide an alarm system that overcomes the shortcomings of the prior art.

Another, secondary object of the present invention is to provide an alarm system including an alarm apparatus for emitting an alarm signal and a notification device for receiving the alarm signal and notifying a user of a specific time.

A further object of the present invention is to provide an alarm system wherein the alarm apparatus includes at least one of an alarm clock, a telephone, a doorbell or any other alerting device.

Another object of the present invention is to provide an alarm system wherein the notification device is a wrist band.

A further object of the present invention is to provide an alarm system wherein the notification device uses a vibrational signal to notify the user of the pending alarm.

Yet another object of the present invention is to provide an alarm system including a transmitter able to transmit a plurality of alarm signals for receipt by a plurality of notification devices.

Still another object of the present invention is to provide an alarm system wherein each of the plurality of notification devices is able to receive at least one of the same and different alarm signals from the transmitter.

Yet another object of present invention is to provide an alarm system wherein the user is able to selectively control the pattern and intensity of the vibrational signal.

Still yet another object of present invention is to provide an alarm system able to transmit signals at a plurality of frequencies each having a unique patterned vibration associated therewith.

Another object of present invention is to provide an alarm system able to transmit signals at a plurality of frequencies each having a unique vibrational intensity associated therewith.

Additional objects of the present invention will appear as the description proceeds.

The present invention overcomes the shortcomings of the prior art by providing an alarm system including an alarm apparatus and at least one notification device wherein the alarm apparatus emits an alarm signal received by the notification device for silently alerting a user. Preferably, the notification device includes a programmable and adjustable vibrational alert for notifying the user.

The foregoing and other objects and advantages will appear from the description to follow. In the description reference is made to the accompanying drawings, which forms a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWING FIGURES

In order that the invention may be more fully understood, it will now be described, by way of example, with reference to the accompanying drawing in which.

Figure 9:
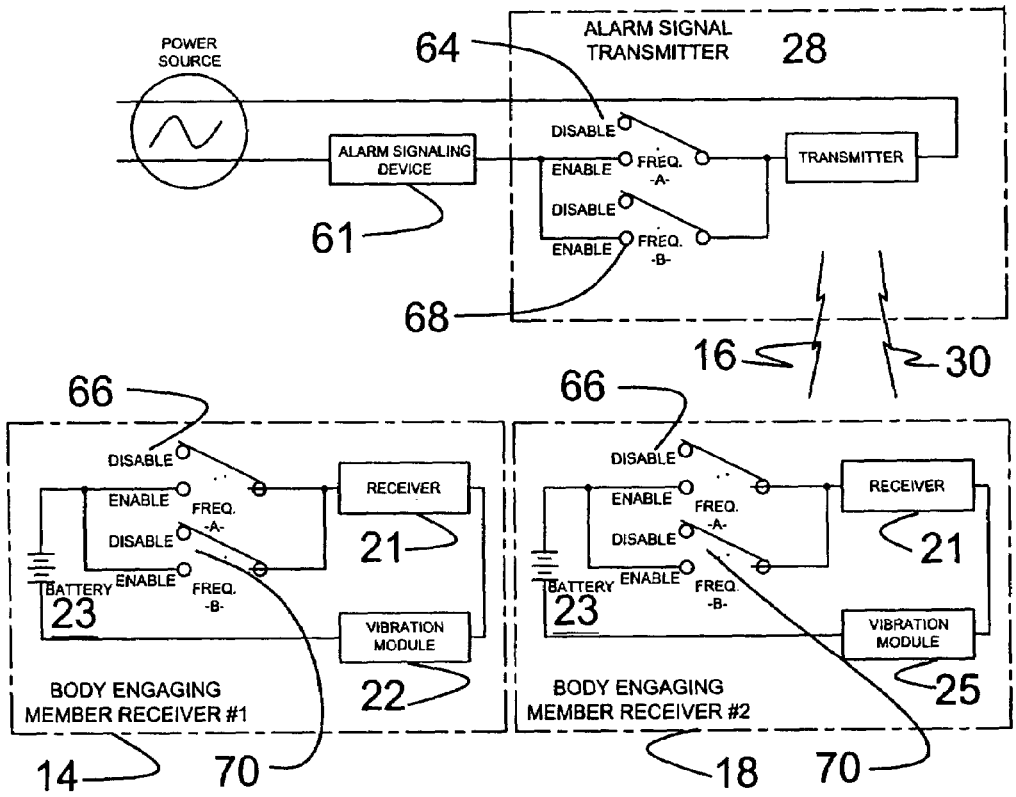
Figure 10:
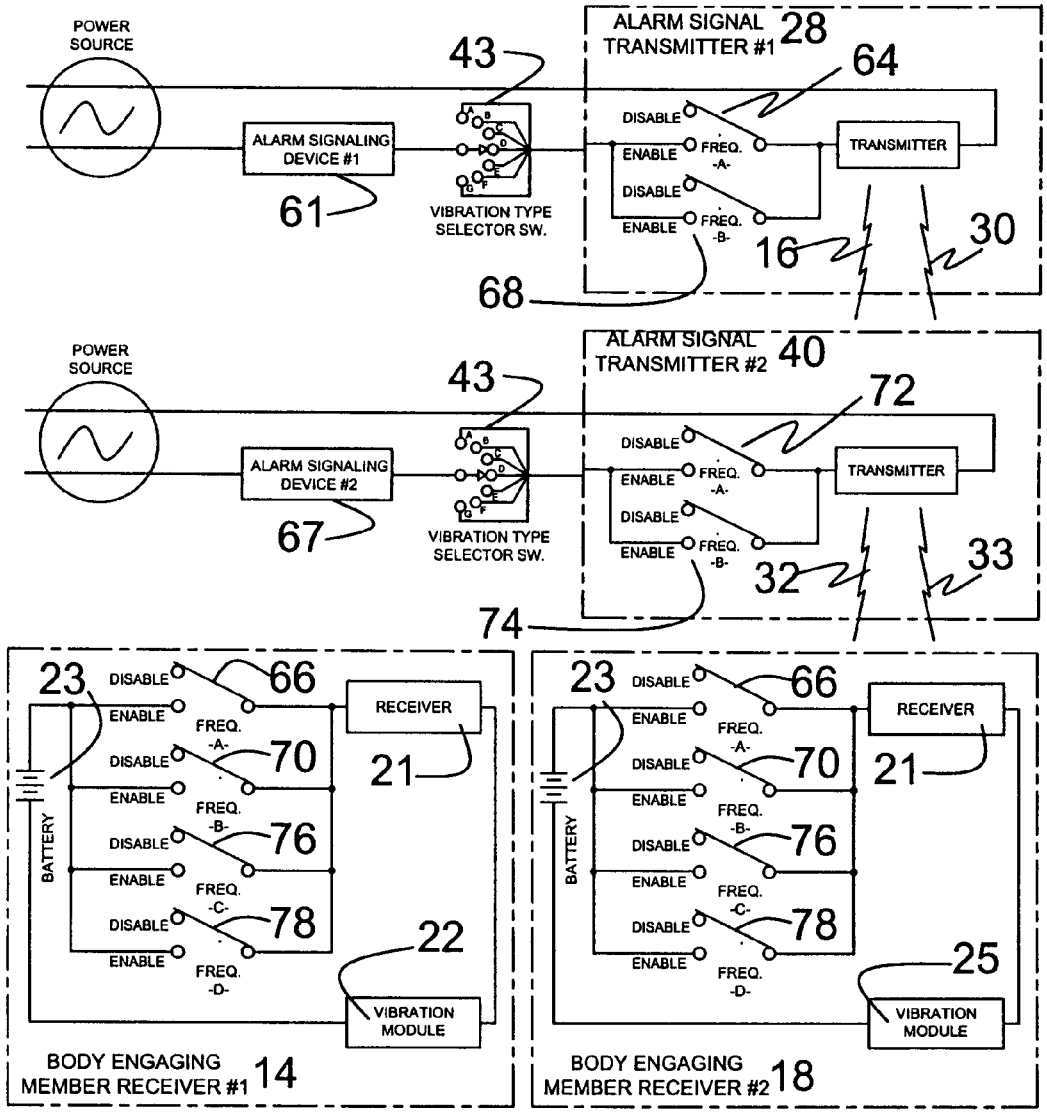

FIG. 9 is an electrical diagram of an alarm system of the present invention with an alarm apparatus transmitting a plurality of alarm signals for receipt by a plurality of notification devices; and FIG. 10 is an electrical diagram of an alarm system of the present invention including a plurality of alarm apparatuses transmitting a plurality of alarm signals for receipt by a plurality of notification device.

DESCRIPTION OF THE REFERENCED NUMERALS

Turning now descriptively to the drawings, in which similar reference characters denote similar elements throughout the several views, the Figures illustrate the alarm system of the present invention. With regard to the reference numerals used, the following numbering is used throughout the various drawing figures.

10 vehicular computer system of the present invention
11 user
12 alarm apparatus
13 second user
14 notification device
16 alarm signal
18 second notification device
20 connection band
21 receiver

22 housing
23 power source
24 third notification device
25 vibration module
26 fourth notification device
28 alarm apparatus transmitter
30 second alarm signal
32 third alarm signal
33 fourth alarm signal
34 second alarm apparatus
36 third alarm apparatus
38 fourth alarm apparatus
40 second transmitter
43 vibration control switch
42 third transmitter
44 vibrational intensity
46 first intensity style
48 second intensity style
50 third intensity style
52 vibrational patter
54 first vibrational patter
56 second vibrational pattern
58 third vibrational patter
60 fourth vibrational pattern
62 fifth vibrational pattern
64 alarm signal actuation switch
66 signal receiver power switch
68 second alarm signal actuation switch
70 second signal receiver power switch
72 third alarm signal actuation switch
74 fourth alarm signal actuation switch

DETAILED DESCRIPTION OF THE PREFERRED EMBODIMENT

The following discussion describes in detail one embodiment of the invention. This discussion should not be construed, however, as limiting the invention to those particular embodiments. Practitioners skilled in the art will recognize numerous other embodiments as well. For definition of the complete scope of the invention, the reader is directed to appended claims.

Turning now descriptively to the drawings, in which similar reference characters denote similar elements throughout the several views, FIGS. 1 through 10 illustrate an alarm system of the present invention indicated generally by the numeral 10.

Figure 1:
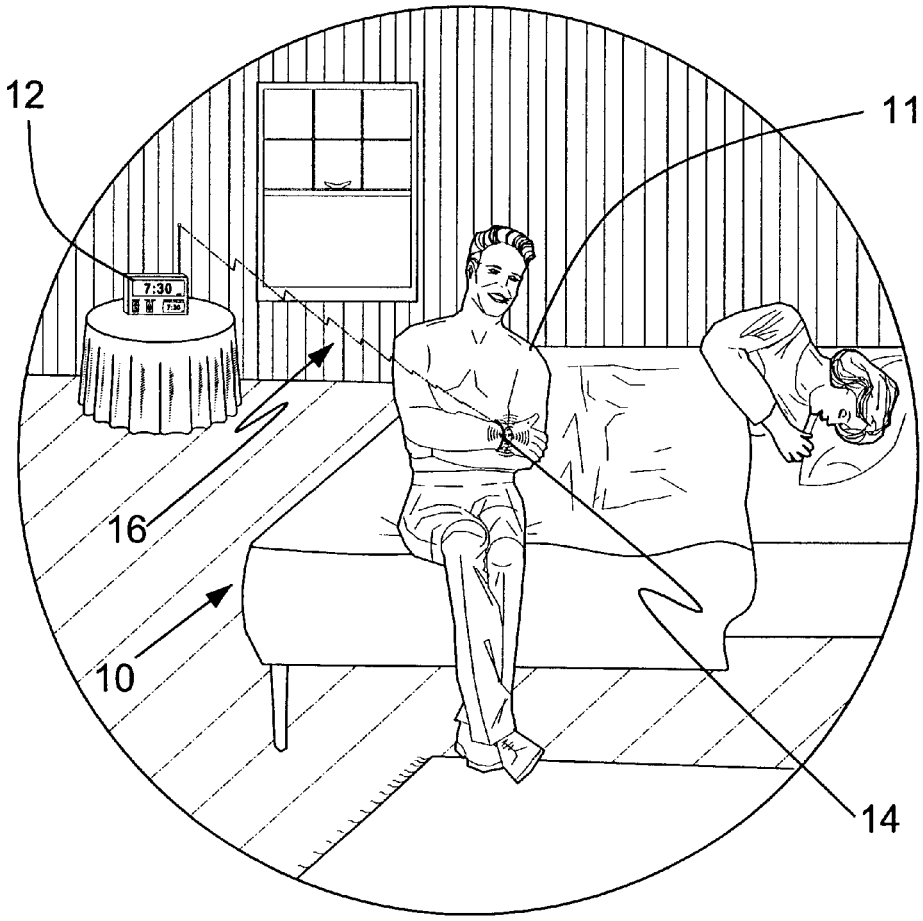
FIG. 1 is an illustrative view of an alarm system of the present invention silently notifying a user.

FIG. 1 is an illustrative view of an alarm system 10 of the present invention silently notifying a user of an alarm. The alarm system 10 includes at least one alarm apparatus 12 and a notification device 14 which is releasably secured to a body of a user 11. The alarm system 10 silently notifies the user 11 of an alarm. The alarm apparatus 12 emits an alarm signal having a predetermined frequency indicated by the line labeled with the numeral 16. The alarm signal 16 is received by the notification device 14 worn by the user 11. Preferably, the alarm signal 16 is an RF signal. However, the alarm apparatus 12 may emit any type of wireless signal which may be received by the notification device 12. Upon receipt of the alarm signal 16, the notification device 14 selectively notifies the user 11. Preferably, the notification device 14 uses a vibrational alert to notify the user 11. However, any method able to silently notify the user 11 of an alarm may be used. As will be discussed hereinafter with respect to FIG. 7, the vibrational alert is selectively programmable to change the intensity and pattern of the vibrations of the notification device 14. The manner in which the alarm signal is emitted from the alarm apparatus 12 and received by the notification device 14 for notifying a user 11 of an alarm will be discussed in more detail hereinafter with specific reference to FIGS. 8–10.

As shown in FIG. 1, the alarm apparatus 12 is an alarm clock. The alarm system 10 of the present invention is advantageous in that the system 10 allows a user 11 to be notified without disturbing other persons in the vicinity of the user 11. This is particularly useful in a situation where two people are sleeping and only one needs to be awaken. This situation is described for purposes of example only and the alarm system 10 of the present invention my be successfully used in any situation where a user 11 must be silently notified of a specific alarm.

Figure 2:
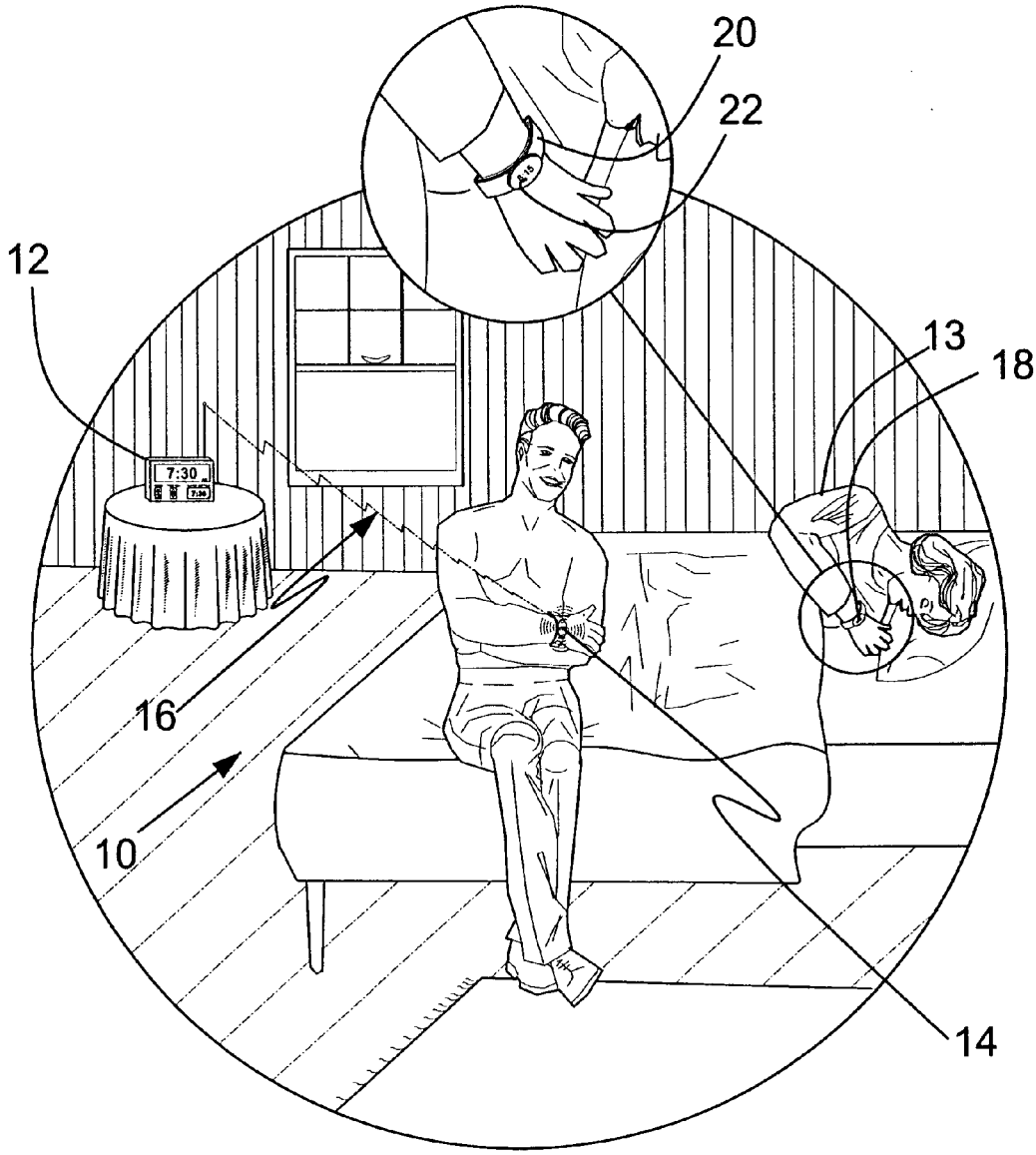
FIG. 2 is an illustrative view of an alarm system of the present invention including a plurality of notification devices for notifying a plurality of users.

FIG. 2 is an illustrative view of an alarm system of the present invention including a plurality of notification devices for notifying a plurality of users of an alarm. The alarm system 10 includes at least one alarm apparatus 12 and a notification device 14 which is releasably secured to a body of a user 11. The alarm system 10 silently notifies the user 11 of an alarm. The alarm apparatus 12 emits an alarm signal having a predetermined frequency indicated by the line labeled with the numeral 16. The alarm signal 16 is received by the notification device 14 worn by the user 11. Preferably, the alarm signal 16 is an RF signal. However, the alarm apparatus 12 may emit any type of wireless signal which may be received by the notification device 12. Upon receipt of the alarm signal 16, the notification device 14 selectively notifies the user 11. Preferably, the notification device 14 uses a vibrational alert to notify the user 11. However, any method able to silently notify the user 11 of an alarm may be used. As will be discussed hereinafter with respect to FIG. 7, the vibrational alert is selectively programmable to change the intensity and pattern of the vibrations of the notification device 14. The manner in which the alarm signal is emitted from the alarm apparatus 12 and received by the notification device 14 for notifying a user 11 of an alarm will be discussed in more detail hereinafter with specific reference to FIGS. 8–10.

It is preferable that the alarm apparatus 12 of the alarm system 10 of the present invention be able to emit a plurality of alarm signals and it is also preferable that the alarm system 10 include a plurality of notification devices each able to receive an alarm signal transmitted at a different frequency. FIG. 2 shows the alarm system 10 further including a second notification device 18 secured to engaging a body of a second user 13. The second notification device 13 also provides silent notification of an alarm to the second user 13. However, the second notification device 18 is able to receive a second alarm signal transmitted at a frequency that is different than the frequency of the first alarm signal 16. The second alarm signal is not shown in FIG. 2. Herein, the first user 11 is being silently notified of the alarm programmed into the alarm apparatus 12 without disturbing the second user 13.

Figure 8:
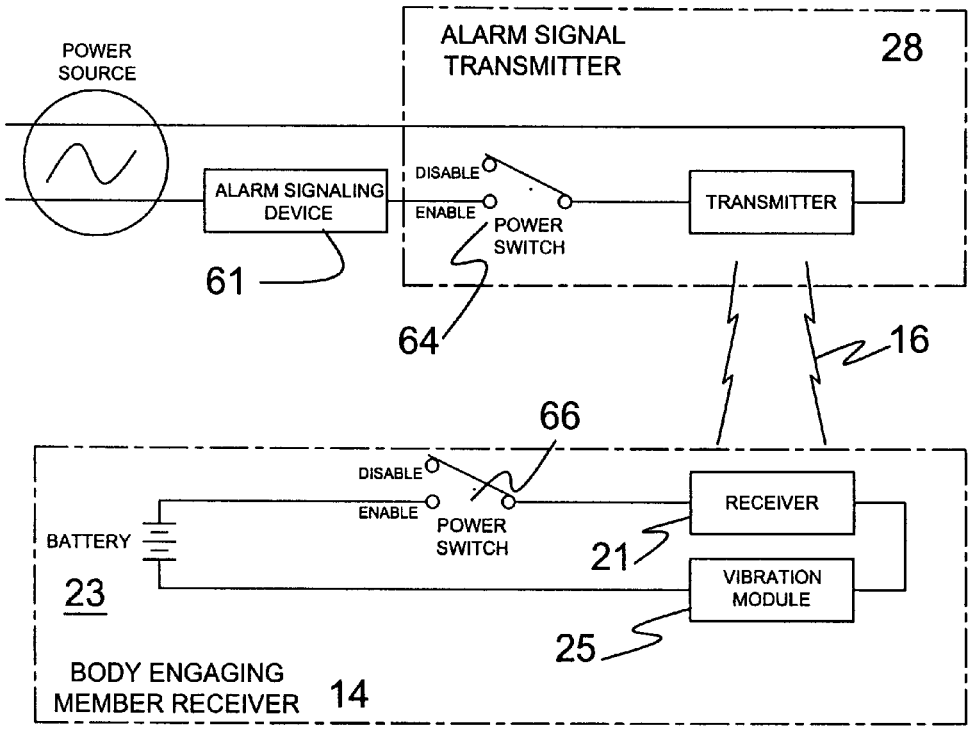
FIG. 8 is an electrical diagram of the alarm system of the present invention having an alarm apparatus transmitting an alarm signal which is received by a notification device.

FIG. 2 also shows an enlarged view of the notification device 14. The notification device 14 includes a band 20 and a housing 22 connected to the band 20. The band 20 selectively secures the notification device 14 to the body of a user 11. The housing 22 includes a receiver 21, a power source 23, a vibration module 25 and a alarm signal receiver switch 66 therein as can be seen in FIG. 8. The above-identified elements contained within the housing 22 will be discussed in greater detail with specific reference to FIGS. 8–10. While only the first notification device 14 is discussed as having the band 20 and the housing 22 connected thereto, it should be noted that any number of notification devices associated with the alarm apparatus 12 of the present invention include the band 20 and a housing 22 connected thereto.

Figure 3:
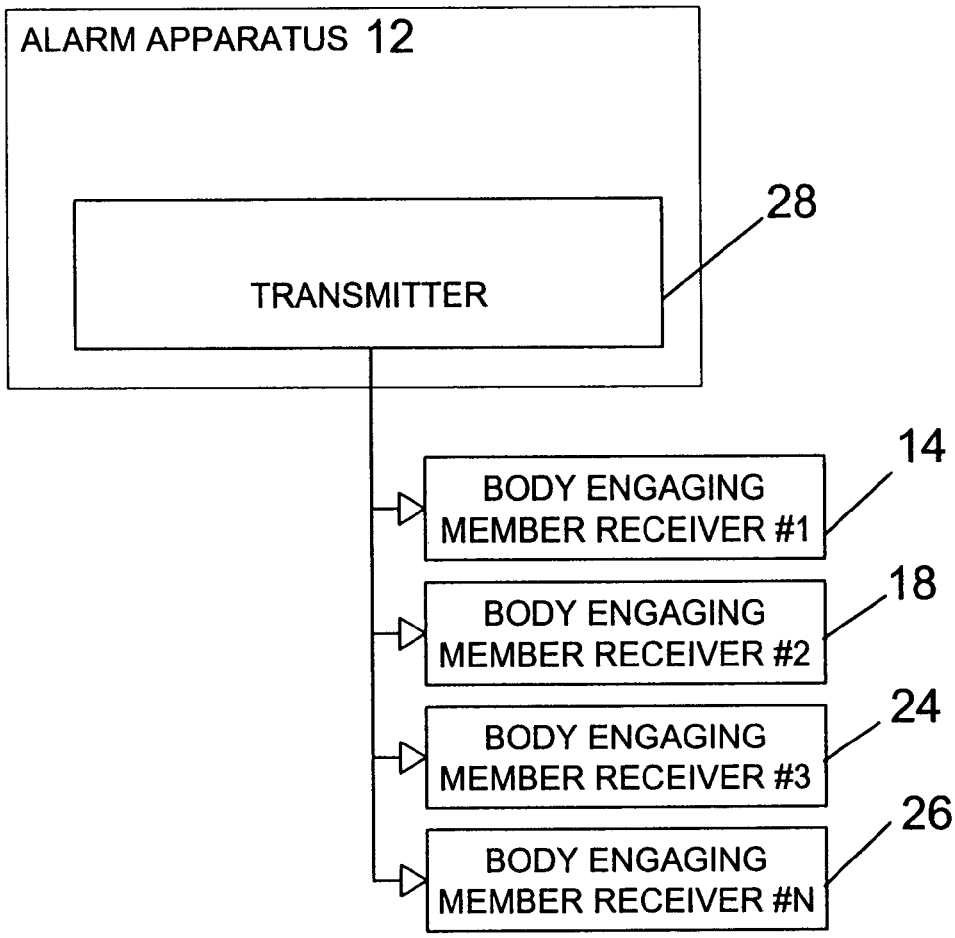
FIG. 3 is a block diagram of an alarm system of the present invention including a plurality of notification device receivers.

FIG. 3 is a block diagram of an alarm system of the present invention with a plurality of notification device receivers. The alarm system 10 includes at least one alarm apparatus 12 and a notification device 14 which is releasably secured to a body of a user 11. The alarm system 10 silently notifies the user 11 of an alarm. The alarm apparatus 12 emits an alarm signal having a predetermined frequency indicated by the line labeled with the numeral 16. The alarm signal 16 is received by the notification device 14 worn by the user 11. Preferably, the alarm signal 16 is an RF signal. However, the alarm apparatus 12 may emit any type of wireless signal which may be received by the notification device 12. Upon receipt of the alarm signal 16, the notification device 14 selectively notifies the user 11. Preferably, the notification device 14 uses a vibrational alert to notify the user 11. However, any method able to silently notify the user 11 of an alarm may be used. As will be discussed hereinafter with respect to FIG. 7, the vibrational alert is selectively programmable to change the intensity and pattern of the vibrations of the notification device 14. The manner in which the alarm signal is emitted from the alarm apparatus 12 and received by the notification device 14 for notifying a user 11 of an alarm will be discussed in more detail hereinafter with specific reference to FIGS. 8–10.

The alarm apparatus 12 includes a transmitter 28 for transmitting the alarm signal to the notification device 14. FIG. 3 shows the transmitter 28 being able to selectively transmit the alarm signal to the first notification device 14 and the second notification device 18. The alarm system 10 also includes a third notification device 24 and a fourth notification device 26. The transmitter 28 is also able to transmit the alarm signal to both the third and fourth notification devices, 24 and 26, respectively. Each respective notification device 14, 18, 24, 26 is able to selectively receive alarm signals having at least one of the same frequency associated therewith and different frequencies associated therewith. For purposes of example, the notifications devices 14, 18, 24, 26 may selectively notify the users to which they are connected upon receiving the alarm signal 16 having one frequency associated therewith. Additionally, for purposes of example, the first notification device 14 is able to receive an alarm signal having a first frequency associated therewith. The second notification device 18 is able to receive an alarm signal having a second frequency associated therewith, the second frequency being different from the first frequency. The third notification device 24 is able to receive an alarm signal having a third frequency associated therewith, the third frequency being different from the first and second frequencies. The fourth notification device 26 is able to receive an alarm signal having a fourth frequency associated therewith, the fourth frequency being different than the first, second and third frequencies. Additionally, the notification devices 14, 18, 24, 26 may be able to selective receive a plurality of alarm signals having different frequencies associated therewith as will be discussed with specific reference to FIG. 4.

Figure 4:
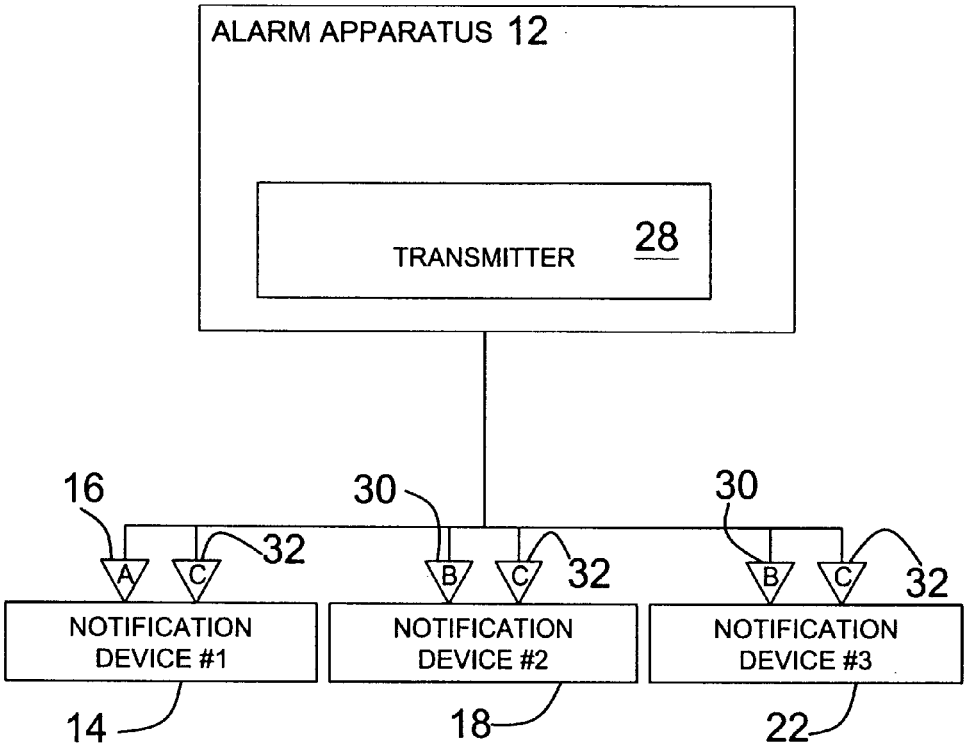
FIG. 4 is a flow chart of an alarm system of the present invention detailing a plurality of notification devices receiving a plurality of alarm signals from an alarm apparatus.

FIG. 4 is a flow chart of an alarm system of the present invention detailing how a plurality of notification devices receive a plurality of alarm signals from an alarm apparatus. The alarm system 10 as shown in FIG. 4 includes the alarm apparatus 12 having the transmitter 28 positioned therein. The alarm apparatus 12 is able to generate three different alarm signals each having a different frequency associated therewith. The alarm apparatus 12 causes the transmitter 28 to transmit the first alarm signal 16, a second alarm signal 30 and a third alarm signal 32. The alarm system 10 further includes the first notification device 14, the second notification device 18, and the third notification device 24. Each notification device 14, 18, 24 is able to selective receive a plurality of alarm signals 16, 30, 32. Furthermore, the notification devices 14, 18, 24 are selectively programmable to receive two of the three alarm signals 16, 30, 32 transmitted by the transmitter 28.

The first notification device 14 is able to receive the first alarm signal 16 and the third alarm signal 32. The second notification device 18 is able to receive the second alarm signal 30 and the third alarm signal 32. Also, the third notification device 24 is able to receive the second alarm signal 30 and the third alarm signal 32. The above specifications are described for purposes of example only and the alarm system may include an alarm apparatus 12 that can selectively transmit any number of alarm signals and the alarm system may also include any number of notification devices each being selectively programmable to receive any combination of alarm signals transmitted by the transmitter of the alarm apparatus.

Figure 5:
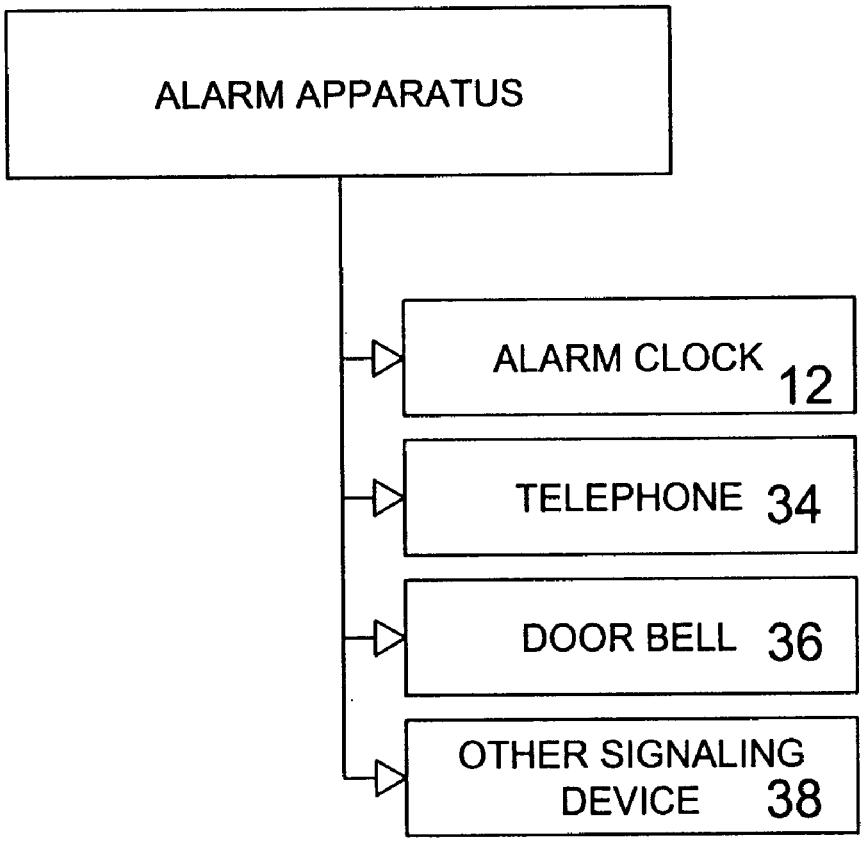
FIG. 5 is a block diagram of an alarm system of the present invention including a plurality of alarm apparatuses.

FIG. 5 is a block diagram of an alarm system of the present invention detailing a plurality of alarm apparatus. The alarm system 10 includes at least one alarm apparatus 12 and a notification device 14 which is releasably secured to a body of a user 11. The alarm system 10 silently notifies the user 11 of an alarm. The alarm apparatus 12 emits an alarm signal having a predetermined frequency indicated by the line labeled with the numeral 16. The alarm signal 16 is received by the notification device 14 worn by the user 11. Preferably, the alarm signal 16 is an RF signal. However, the alarm apparatus 12 may emit any type of wireless signal which may be received by the notification device 12. Upon receipt of the alarm signal 16, the notification device 14 selectively notifies the user 11. Preferably, the notification device 14 uses a vibrational alert to notify the user 11. However, any method able to silently notify the user 11 of an alarm may be used. As will be discussed hereinafter with respect to FIG. 7, the vibrational alert is selectively programmable to change the intensity and pattern of the vibrations of the notification device 14. The manner in which the alarm signal is emitted from the alarm apparatus 12 and received by the notification device 14 for notifying a user 11 of an alarm will be discussed in more detail hereinafter with specific reference to FIGS. 8–10.

FIG. 5 shows that alarm system 10 of the present invention may include a plurality of alarm apparatus for signaling a user. The alarm apparatus 12 may include at least one of an alarm clock 35, a telephone 34, a doorbell 36 and any other signaling device 38. These apparatuses are shown for purposes of example and in practice and device may be adapted for use by including a timing device and transmitter.

Figure 6:
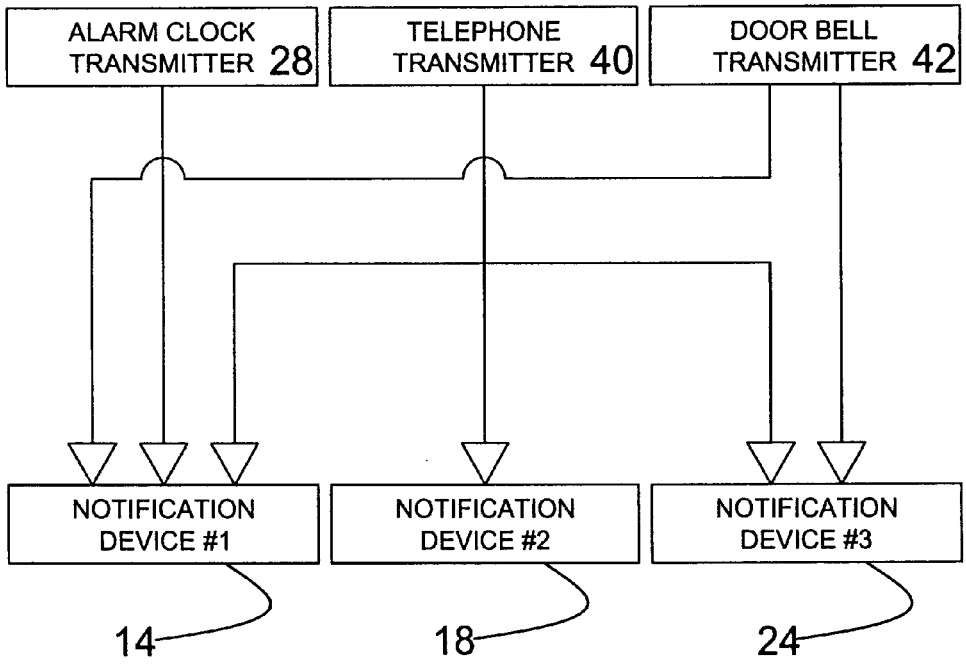
FIG. 6 is a flow chart of an alarm system of the present invention including a plurality of alarm apparatuses signaling a plurality of notification devices.

FIG. 6 is a flow chart of an alarm system of the present invention including a plurality of alarm apparatus signaling a plurality of notification devices. The alarm system 10 of the present invention includes the first notification device 14, the second notification device 18 and the third notification device 24. The notification devices 18 are able to selectively receive alarm signals transmitted by a plurality of alarm apparatus 12. As shown herein, the alarm apparatus include the alarm clock 35 having a first transmitter 28, the telephone 34 having a second transmitter 40 and the doorbell 36 having the third transmitter 42. Each respective transmitter 28, 40, 42 transmits an alarm signal therefrom for receipt by the notification devices 14, 18, 24. Each alarm signal transmitted by the transmitters 28, 40, 42 has a different frequency associated therewith.

FIG. 6 shows that first notification device 14 is able to receive alarm signals from the first transmitter 28 of the alarm clock 35, the second transmitter 40 of the telephone 34 and the third transmitter 42 of the doorbell 36. The second notification device 18 is only able to receive an alarm signal transmitted from the second transmitter 40 of the telephone 34. The third notification device 24 is able to receive the alarm signal transmitted from the second transmitter 40 of the telephone 34 and the third transmitter 42 of the door bell 36. The above is described for purposes of example only, and the notification devices may be able to receive alarm signals from any alarm apparatuses connected to the alarm system 10 of the present invention.

Figure 7:
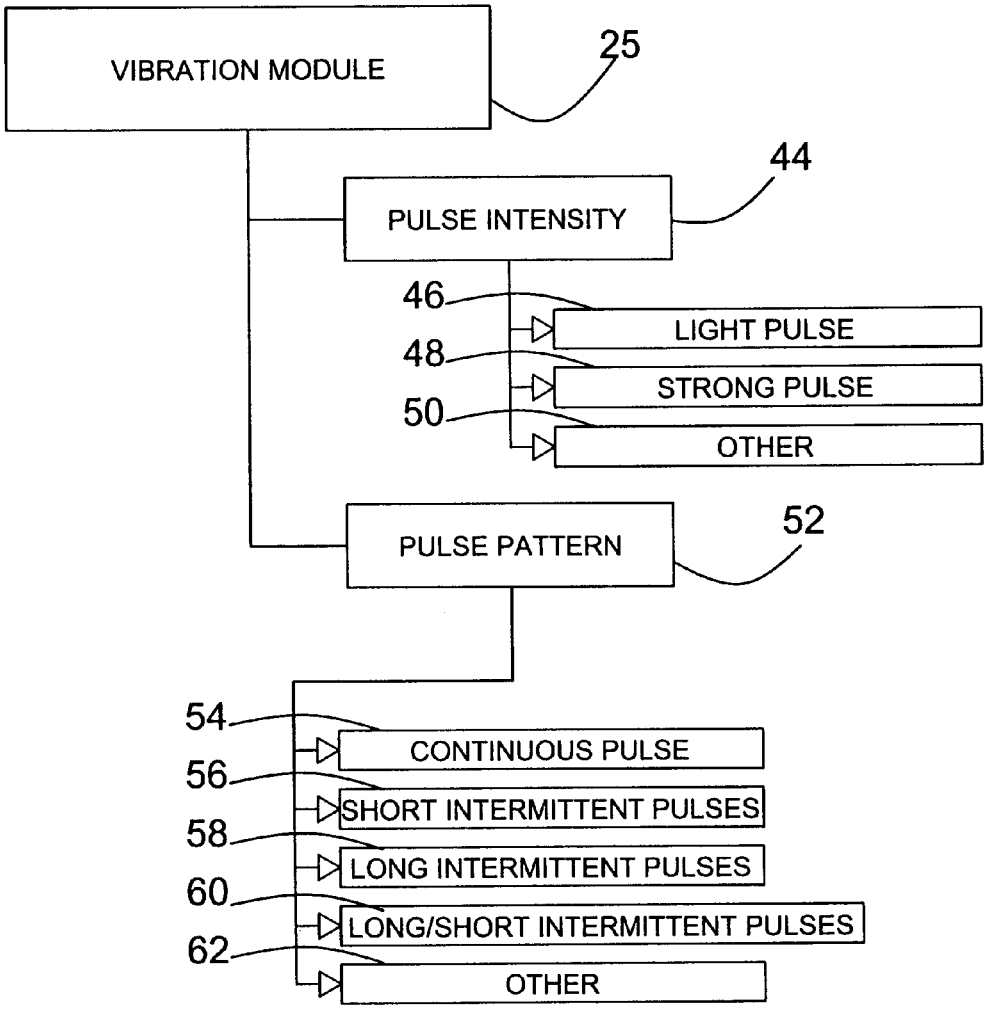
FIG. 7 is a block diagram of the programmable vibrational pattern of the notification device of an alarm system of the present invention.

FIG. 7 is a block diagram of the programmable vibrational pattern of the notification device of an alarm system of the present invention. The alarm system 10 includes at least one alarm apparatus 12 and a notification device 14 which is releasably secured to a body of a user 11. The alarm system 10 silently notifies the user 11 of an alarm. The alarm apparatus 12 emits an alarm signal having a predetermined frequency indicated by the line labeled with the numeral 16. The alarm signal 16 is received by the notification device 14 worn by the user 11. Preferably, the alarm signal 16 is an RF signal. However, the alarm apparatus 12 may emit any type of wireless signal which may be received by the notification device 12. Upon receipt of the alarm signal 16, the notification device 14 selectively notifies the user 11. Preferably, the notification device 14 uses a vibrational alert to notify the user 11. However, any method able to silently notify the user 11 of an alarm may be used. The vibrational alert is selectively programmable to change the intensity and pattern of the vibrations of the notification device 14. The manner in which the alarm signal is emitted from the alarm apparatus 12 and received by the notification device 14 for notifying a user 11 of an alarm will be discussed in more detail hereinafter with specific reference to FIGS. 8–10.

The housing 22 includes the vibration module 25 contained therein. A user can selectively change the pulse intensity 44 and the pulse pattern 52 of the vibration module 25. As shown in FIG. 7, the intensity of the pulse 44 can be a first intensity 46, a second intensity 48 and a third intensity 50. The first intensity 46 is a light pulse. The second intensity 46 is a strong pulse. The third intensity 50 maybe any intensity falling between the range of strong pulse and light pulse. The levels of intensity are described for purposes of example only and the vibration module may vibrate at any intensity level. The pulse pattern 52 can be a first pattern 54, a second pattern 56, a third pattern 58, a fourth pattern 60 and a fifth pattern 62. The first pattern 54 is a continuous pulse. The second pattern 56 is a short intermittent pulse. The third pattern 58 is a long intermittent pulse. The fourth pattern 60 is a long then short intermittent pulse and the fifth pattern may be any series of pulses. The pulse patterns are described for purposes of example only and the vibration module may vibrate in any pattern. Since the notification devices may vibrate in a plurality of patterns and at a plurality of intensities, each user may select a level that is comfortable to them and that would notify them without startling them.

FIG. 8 is an electrical diagram of the alarm system of the present invention having an alarm apparatus transmitting an alarm signal which is received by a notification device. The alarm apparatus 12 includes a signaling device 61, the transmitter 28 and a power source connected thereto. A signaling switch 64 is connected between the signaling device and the transmitter 28. The housing 22 of the notification device 14 includes the receiver 21, a power source 23, a vibration switch 66 connected therebetween and a vibration module 25.

Upon the signaling device 61 determining that a predetermined time or event has occurred, the signaling switch 64 is caused to move from the first disabled position to the second enabled position thus completing an electrical circuit. Thereafter, the transmitter 28 transmits the alarm signal 16 having a unique frequency associated therewith for receipt by the receiver 21 of the notification device 14. Upon receipt of the alarm signal 16, the receiver 21 causes the vibration switch to move from a first disabled position to a second enabled position thereby completing an electrical circuit and causing the vibration module 25 to vibrate and silently alert the user.

FIG. 9 is an electrical diagram of an alarm system of the present invention with an alarm apparatus transmitting a plurality of alarm signals for receipt by a plurality of notification devices. The alarm apparatus 12 includes the signaling device 61, the transmitter 28 and a power source connected thereto. The alarm apparatus includes the first switch 64 for enabling generation of a signal at a first frequency "A" and a second switch 68 for enabling generation of a signal at a second frequency "B". The first and second signaling switches 64 and 68, respectively, are connected between the signaling device 61 and the transmitter 28. The alarm system includes the first notification device 14 and the second notification device 18. The housing 22 of the notification devices 14, 18 each include the receiver 21, the power source 23, a first vibration switch 66 and a second vibration switch 70 connected therebetween. The notification devices also each include a vibration module 25 connected between the power source 23 and the receiver 21.

The alarm signaling device 61 is able to cause two signals, each having a different frequency associated therewith, to be transmitted by the transmitter 28. Upon the signaling device 61 determining that a first predetermined time or event has occurred, the first signaling switch 64 is caused to move from the first disabled position to the second enabled position thus completing an electrical circuit. Thereafter, the transmitter 28 transmits the first alarm signal 16 at a Frequency "A". The receiver 21 of the notification device 14 receives the first alarm signal transmitted at Frequency "A" and causes the first vibration switch 66 to move from a first disabled position to a second enabled position thereby completing an electrical circuit and causing the vibration module 25 to vibrate and silently alert the user.

Upon the signaling device 61 determining that a second predetermined time or event has occurred, the second signaling switch 64 is caused to move from the first disabled position to the second enabled position thus completing an electrical circuit. Thereafter, the transmitter 28 transmits the second alarm signal 30 at a Frequency "B". The receiver 21 of the notification device 14 receives the second alarm signal 30 having Frequency "B" associated therewith and causes the second vibration switch 70 to move from a first disabled position to a second enabled position thereby completing an electrical circuit and causing the vibration module 25 to vibrate and silently alert the user.

It should be noted that the notification devices 14, 18 can be selectively programmed to receive at least one of the first alarm signal 16, the second alarm signal 30, and both the first and second alarm signals 16 and 30 respectively. The ability to receive one signal and not the other allows the alarm system 10 to be programmed to remind two different users of two different events or times.

FIG. 10 is an electrical diagram of an alarm system of the present invention including a plurality of alarm apparatuses transmitting a plurality of alarm signals for receipt by a plurality of notification device. The alarm system 10 in FIG. 10 includes the first alarm apparatus 12 and the second alarm apparatus.

The first alarm apparatus 12 includes the first signaling device 61, the first transmitter 28 and the first power source connected thereto. The alarm apparatus includes the first signaling switch 64 for enabling generation of a signal at a first frequency "A" and a second signaling switch 68 for enabling generation of a signal at a second frequency "B". The first and second signaling switches 64 and 68, respectively, are connected between the signaling device 61 and the transmitter 28. The first alarm apparatus 12 further includes pattern selection switch 43 connected between the first signaling device 61 and the first and second signal switches 64 and 68, respectively.

The second alarm apparatus 34 includes the second signaling device 67, the second transmitter 40 and the second power source connected thereto. The second alarm apparatus 34 includes the third signaling switch 72 for enabling generation of a signal at a third frequency "C" and a fourth signaling switch 74 for enabling generation of a signal at a fourth frequency "D". The third and fourth signaling switches 72 and 74, respectively, are connected between the second signaling device 67 and the second transmitter 40. The second alarm apparatus 12 further includes the pattern selection switch 43 connected between the first signaling device 61 and the first and second signal switches 64 and 68, respectively for selecting a vibrational intensity and pattern for the notification devices 14, 18.

The alarm system includes the first notification device 14 and the second notification device 18. The housing 22 of the notification devices 14, 18 includes the receiver 21, the power source 23, the first vibration switch 66, the second vibration switch 70, a third vibration switch 76 and a fourth vibration 78 switch connected therebetween. The notification device also includes a vibration module 25 connected between the power source 23 and the receiver 21.

The first signaling device 61 is able to cause two signals, each having a different frequency associated therewith, to be transmitted by the transmitter 28. Upon the signaling device 61 determining that first a predetermined time or event has occurred, the signaling device 61 causes the pattern switch 43 to connect to a lead corresponding with a desired vibrational pattern and intensity. Thereafter, the first signaling switch 64 is caused to move from the first disabled position to the second enabled position thus completing an electrical circuit. Thereafter, the transmitter 28 transmits the first alarm signal 16 at the Frequency "A". The receiver 21 of the notification device 14 receives the first alarm signal transmitted at Frequency "A" and causes the first vibration switch 66 to move from a first disabled position to a second enabled position thereby completing an electrical circuit and causing the vibration module 25 to vibrate and silently alert the user.

Upon the signaling device 61 determining that a second predetermined time or event has occurred, the signaling device 61 causes the pattern switch 43 to connect to a lead corresponding to a desired vibrational pattern and intensity. Thereafter, the second signaling switch 64 is caused to move from the first disabled position to the second enabled position thus completing an electrical circuit. Thereafter, the transmitter 28 transmits the second alarm signal 30 at the Frequency "B". The receiver 21 of the notification device 14 receives the second alarm signal 30 transmitted at Frequency "B" and causes the second vibration switch 70 to move from a first disabled position to a second enabled position thereby completing an electrical circuit and causing the vibration module 25 to vibrate and silently alert the user.

When a third time or event is determined to have occurred, the second signaling device 67 of the second alarm apparatus 34 causes the pattern selection switch 43 to connect to a lead corresponding with a desired pattern and intensity. Thereafter, the third signaling switch 72 is caused to move from the first disabled position to the second enabled position thus completing an electrical circuit. Thereafter, the second transmitter 40 transmits the third alarm signal 32 at a Frequency "C". The receiver 21 of the notification device 14 receives the third alarm signal 30 transmitted at Frequency "C" and causes the third vibration switch 76 to move from a first disabled position to a second enabled position thereby completing an electrical circuit and causing the vibration module 25 to vibrate and silently alert the user.

When a fourth time or event is determined to have occurred, the second signaling device 67 of the second alarm apparatus 34 causes the pattern selection switch 43 to connect to a lead corresponding with a desired pattern and intensity. Thereafter, the fourth signaling switch 74 is caused to move from the first disabled position to the second enabled position thus completing an electrical circuit. Thereafter, the second transmitter 40 transmits the fourth alarm signal 33 at a Frequency "D" associated therewith. The receiver 21 of the notification device 14 receives the fourth alarm signal 33 transmitted at Frequency "D" and causes the fourth vibration switch 78 to move from a first disabled position to a second enabled position thereby completing an electrical circuit and causing the vibration module 25 to vibrate and silently alert the user.

It should be noted that the notification devices 14, 18 can be selectively programmed to receive at least one of the first alarm signal 16, the second alarm signal 30, third alarm signal 32, fourth alarm signal 33 and any combination of the first, second, third and fourth alarm signals 16, 30, 32, and 33 respectively. The ability to receive one signal and not the other allows the alarm system 10 to be programmed to remind two different users of different events or times.

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

The invention claimed is:

1. An alarm system comprising:

a) multiple alarm devices including an alarm clock, a telephone, and a door bell, each alarm device including means for generating an alarm signal, and a transmitter connected to each said generating means for transmitting an alarm signal at a frequency different for each of said alarm devices and selected users so that each alarm device issues a different frequency signal for each selected user;

b) a silent notification device comprising a vibration module for each of said users including a receiver for receiving an alarm signal at a selected frequency unique to a specific user and to a specific alarm device and means in each notification device for alerting a user that said notification device has received an alarm signal from a particular alarm device, each notification device receiving alarm signals from more than one alarm device so that each user receives alarms signals from different alarm devices; and c) each said vibration module being selectively programmable by a user to change individually the intensity of either a light pulse or a strong pulse and a pattern of the vibrations comprising one of a continuous pulse short intermittent pulses, long intermittent pulses, or long/short intermittent pulses to indicate to a user which alarm device is issuing the alarm signal; and d) each said vibration module is mounted on a wrist band worn by a user.

2. An alarm method comprising the steps of:

a) deploying multiple alarm devices including an alarm clock, a telephone, and a door bell, each alarm device generating an alarm signal;

b) each alarm device using a transmitter for transmitting the alarm signal at a frequency different for each of selected users and unique to the alarm device generating the alarm signal;

c) each of said users receiving an alarm signal from more than one alarm device at selected frequencies unique to a specific user and to a specific alarm device and having a notification device for alerting a user that an alarm signal from a particular alarm device has been received; and d) each user programming his or her own notification device to receive the alarm signals from said alarm devices and each notification device issuing a vibratory alarm signal having an intensity of either a light pulse or a strong pulse and pattern of vibrations comprising one of a continuous pulse, short intermittent pulses, long intermittent pulses, or long/short intermittent pulses specific to a particular alarm device.

* * * * *